US007665806B2

(12) United States Patent
Rotz et al.

(10) Patent No.: US 7,665,806 B2
(45) Date of Patent: Feb. 23, 2010

(54) CONTAINMENT WALL CLOSURE DEVICE FOR MILLING MACHINE CUTTER DRUM ASSEMBLY

(75) Inventors: Dana R. Rotz, Shippensburg, PA (US); Christopher L. Junga, Carlisle, PA (US)

(73) Assignee: Volvo Construction Equipment AB, Eskilstuna (SE)

( * ) Notice: Subject to any disclaimer, the term of this patent is extended or adjusted under 35 U.S.C. 154(b) by 456 days.

(21) Appl. No.: 11/451,786

(22) Filed: Jun. 13, 2006

(65) Prior Publication Data

US 2007/0284933 A1 Dec. 13, 2007

(51) Int. Cl.
*E01C 23/09* (2006.01)

(52) U.S. Cl. ..... 299/39.4; 404/90

(58) Field of Classification Search ..... 299/39.3, 299/39.4, 39.6, 75, 76, 39.1; 404/90, 93, 404/94

See application file for complete search history.

(56) References Cited

U.S. PATENT DOCUMENTS 3,137,984 A 6/1964 Skonkwiler
3,746,101 A 7/1973 Takata
3,901,325 A 8/1975 Richards
4,049,059 A 9/1977 Weibling
4,221,434 A 9/1980 Swisher, Jr. et al.
4,421,176 A 12/1983 Tuggle et al.
4,938,537 A 7/1990 Rife, Jr. et al.
5,907,915 A 6/1999 Satzler
6,623,083 B1 9/2003 Risi

*Primary Examiner*—Sunil Singh
(74) *Attorney, Agent, or Firm*—Michael Best & Friedrich LLP

(57) ABSTRACT

A closure device for a containment wall shaft opening is for a milling machine cutter drum assembly including a drum and a drive shaft for rotating the drum, the shaft extending through the wall opening to connect the drum with a mainframe and the shaft and or wall be relatively displaceable. A barrier member is movably coupled with the mainframe so as to be pivotable about an axis fixed with respect to the drum shaft and is disposeable against the containment wall prevent material flow through the wall opening. A coupler is configured to movably couple the barrier member with the containment wall such that relative vertical displacement between the drum shaft and the containment wall angularly displaces the barrier member about the axis as the position of the shaft within the opening is varied so that the barrier member extends across and obstructs the wall opening.

26 Claims, 10 Drawing Sheets

CONTAINMENT WALL CLOSURE DEVICE FOR MILLING MACHINE CUTTER DRUM ASSEMBLY

The present invention relates to road construction machinery, and more particularly to material containment devices for road milling machine cutter drums.

One type of road construction vehicle, commonly referred to as a road milling machine, generally includes a mainframe, a cutting drum rotatably mounted to the frame for removing material (e.g., asphalt, concrete) from a roadbed, and a conveyor. The cutting drum is connected with the mainframe by a drive assembly that includes a shaft, and operates by rotatably engaging with a road surface to remove material therefrom. As the material is removed, the depth of engagement of the drum generally must be increased in order to remove a desired quantity of material. Typically, adjustment of the drum depth is achieved by vertically moving the mainframe and thereby the connected drum assembly.

Further, road milling machines generally include an enclosure or housing for retaining material cuttings about the drum until the material can be conveyed to a desired location (e.g., a dump truck bed). Such housings include one or more containment walls or "side skirts" that enclose the area about the drum, each skirt being typically vertically moveable relative to the drum. As such, the side skirts are able to either remain vertically stationary when the drum depth is adjusted or to move vertically in order to remain disposed on a sloping base surface during machine travel. Generally, at least one side skirt has an opening through which the drum shaft extends between drive components connected with the mainframe and the drum. This containment wall opening typically extends generally vertically in order to enable relative displacement between the shaft and the wall.

SUMMARY OF THE INVENTION

In one aspect, the present invention is a device for closing a shaft opening in a containment wall of a milling machine cutter drum assembly. The drum assembly includes a rotatable drum and a drive shaft for rotating the drum about an axis, the shaft extending through the containment wall opening so as to connect the drum with a mainframe of the milling machine. At least one of the drum shaft and the containment wall is vertically movable and the wall shaft opening extends generally vertically in the wall. The closure device comprises a barrier member movably coupled with the mainframe so as to be pivotable about an axis. The barrier axis is generally fixed with respect to the drum shaft such that the barrier member is linearly displaceable with respect to the containment wall. The barrier member is disposeable generally against the containment wall so as to extend at least partially across the wall shaft opening to generally prevent material flow through the opening. Further, a coupler is configured to movably couple the barrier member with the containment wall such that vertical linear displacement of either the drum shaft with respect to the containment wall, or the containment wall with respect to the drum shaft, angularly displaces the barrier member about the barrier axis. As such, while the vertical position of the drum shaft within the opening is varied, at least a portion of the barrier member extends across and generally obstructs the wall opening.

In another aspect, the present invention is again a device for closing a shaft opening in a containment wall of a milling machine cutter drum assembly, the drum assembly and machine being generally as described above. The closure device comprises a barrier member movably connected with the mainframe so as to be pivotable about an axis, the barrier axis being generally fixed such that the containment wall is linearly displaceable with respect to the axis. The barrier member is disposeable generally against the containment wall so as to extend at least partially across the wall shaft opening to prevent material flow through the opening. A linkage is configured to angularly displace the barrier member about the barrier axis when either the wall displaces vertically with respect to the containment wall or the wall displaces vertically with respect to the shaft such that at least a portion of the barrier member extends across and generally obstructs the wall opening as the drum shaft displaces vertically within the opening.

In a further aspect, the present invention is a milling machine cutter assembly, the milling machine including a mainframe. The cutter assembly comprises a cutter drum having lateral ends and being rotatable about a central axis and a drive shaft connected with and configured to rotate the drum. A containment wall is configured to generally contain material along one lateral side of the cutter drum and has a vertically extending drive opening. The drum shaft extends through the drive opening so as to connect the drum assembly with a mainframe of the milling machine. Further, the containment wall is vertically movable with respect to the drum shaft and the wall shaft opening extends vertically in the wall. A barrier plate is movably connected with the mainframe so as to be pivotable about an axis, the barrier axis being generally fixed such that the containment wall is linearly displaceable with respect to the axis. Also, the barrier plate is disposeable generally against the containment wall so as to extend at least partially across the wall shaft opening to prevent material flow through the opening. Furthermore, a coupler is configured to movably couple the barrier member with the containment wall such that vertical linear displacement of either the drum shaft with respect to the containment wall, or the containment wall with respect to the drum shaft, angularly displaces the barrier member about the barrier axis. As such, while the vertical position of the drum shaft within the opening is varied, at least a portion of the barrier member extends across and generally obstructs the wall opening.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings:

FIG. 8, are each a side elevational view of the closure device and the containment wall, each showing the closure device at a different angular position about an axis and the drum shaft at a different vertical position with respect to the wall;

DETAILED DESCRIPTION OF THE INVENTION

Figure 1:
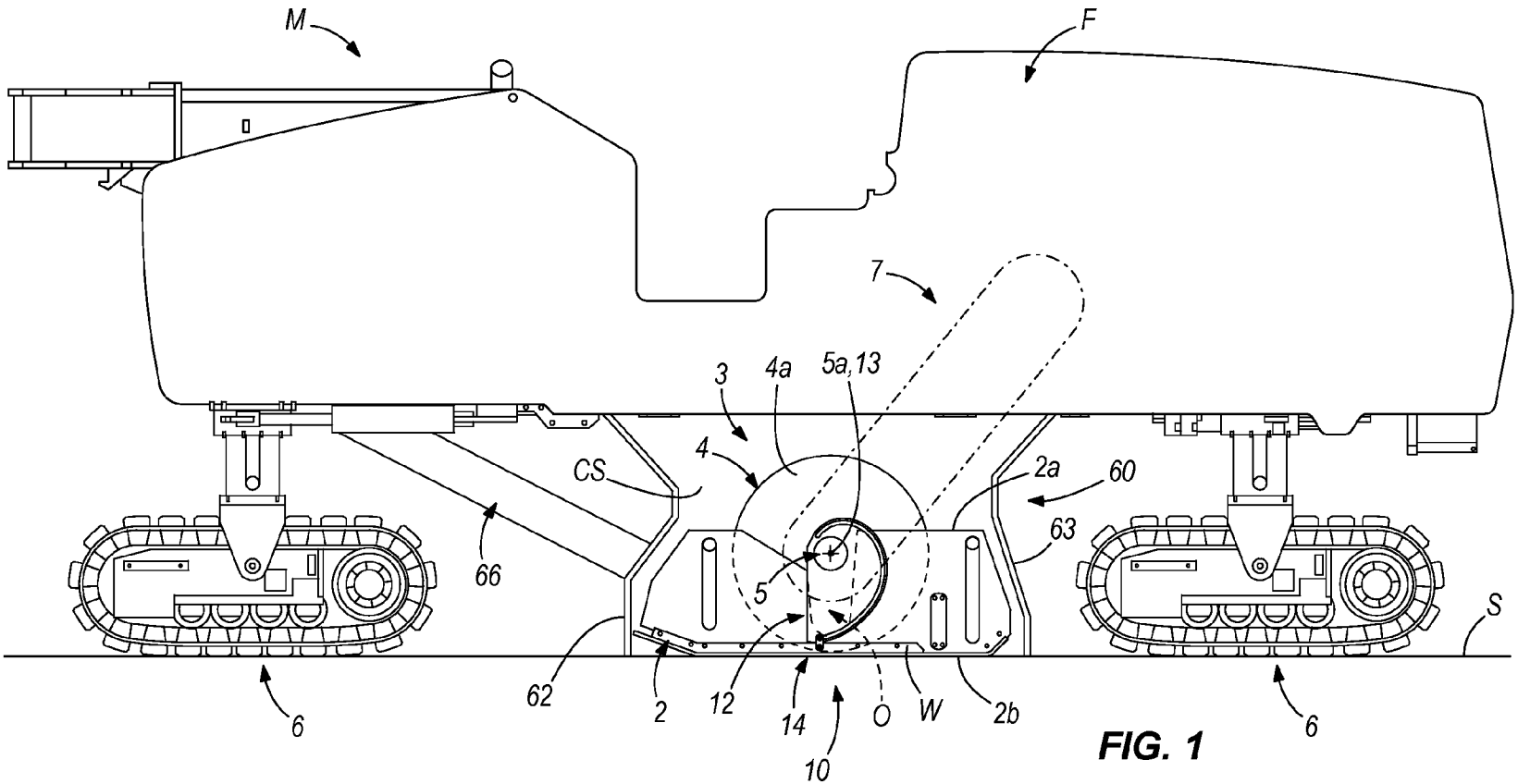
FIG. 1 is a side elevational view of a closure device in accordance with the present invention, shown in a first limit position and mounted on a containment wall of a milling machine with a machine mainframe and a cutting drum in upper positions.

Certain terminology is used in the following description for convenience only and is not limiting. The words "upper", "upward", "down" and "downward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

Referring now to the drawings in detail, wherein like numbers are used to indicate like elements throughout, there is shown in FIGS. 1-15 a closure device 10 for closing a shaft opening 1 in a slotted containment wall 2 of a milling machine cutter drum assembly 3. The drum assembly 3 includes a rotatable cutting drum 4 and a drive shaft 5 extending through the containment wall opening 1 so as to connect the drum 4 with a mainframe F of the milling machine M, the drum drive shaft 5 being rotatable about a central axis 5*a* to rotate the cutting drum 4 thereabout. The containment wall 2 has upper and lower ends 2*a*, 2*a*, respectively, and outer and inner surfaces 2*c*, 2*d*, respectively, extending between the two ends 2*a*, 2*a*, and is vertically movable with respect to the drum shaft 5. The wall shaft opening 1 preferably extends generally vertically in the slotted wall 2 between the wall upper and lower ends 2*a*, 2*b* and horizontally between the inner and outer surfaces 2*c*, 2*d*. The closure device 10 basically comprises a barrier member 12 movably coupled with the mainframe M and a coupler 14. The barrier member 12 is pivotable about an axis 13 that is generally fixed with respect to the mainframe F, and preferably at least generally collinear with the drive shaft axis 5*a*, such that the containment wall 2 is linearly displaceable with respect to the barrier member 12, and vice-versa. Preferably, the barrier member 12 is pivotally coupled with the drum drive shaft 5, and most preferably mounted to a portion thereof, such that the barrier axis 13 is substantially collinear with the drum shaft axis 5*a*. However, the barrier member 12 may alternatively be mounted to a separate shaft (none shown) coupled with the drum shaft 5 or may be directly connected with the mainframe F (structure not shown). Further, the barrier member 12 is disposeable generally against the containment wall 2, most preferably against the wall outer surface 2*c* as discussed below, so as to extend at least partially across the wall shaft opening 1 to generally prevent material flow through the opening 1.

As best shown in FIGS. 8A-8F, the coupler 14 is configured to movably couple the barrier member 12 with the containment wall 2 such that vertical linear displacement of either the drum shaft 5 with respect to the containment wall 2, or alternatively of the wall 2 with respect to the shaft 5, angularly displaces the barrier member 12 about the barrier axis 13. Thereby, as the vertical position $P_S$ of the drum shaft 5 within the wall opening 1 is varied, at least a portion of the barrier member 12 extends across and generally obstructs the opening 1. More specifically, the drum shaft 5 is varyingly located within different sections of the containment wall opening 1 as the drum shaft 5 moves with respect to the containment wall 2, or vice-versa, such that varying remaining sections of the wall opening 1 are unobstructed by the shaft 5, through which material could potentially flow. In order to prevent such material flow, the coupler 14 is configured to pivot the barrier member 12 about the barrier axis 13 such that at least a portion of the barrier member 12 extends across and generally obstructs at least lower portions of the remaining sections of the wall opening 1 (i.e., the sections not obstructed by the shaft 5).

Furthermore, the barrier member 12 preferably has opposing, generally vertically-extending outer and inner surfaces 12*a*, 12*a*, with the inner surface 12*b* (see FIG. 15) preferably being slidably disposed against the containment wall outer surface 2*c*, the wall 2 thus being located between the member 12 and the drum 4 such that the wall inner surface 2*d* is spaced laterally from one side end 4*a* of the drum 4. As such, sections of the barrier member inner surface 12*b* generally slidably pivot against the wall outer surface 2*c*, while other sections of the inner surface 12*b* obstruct the opening 1 and thus act as a "barrier" against the flow of cutting material therethrough. However, the barrier member 12 may alternatively be disposed against the containment wall inner surface 2*d*, and thus between the containment wall 2 and the drum end 4*a*, such that barrier outer surface 12*a* slides against the wall inner surface 2*d* and the barrier inner surface 12*b* acts as a material flow barrier.

Figure 2:
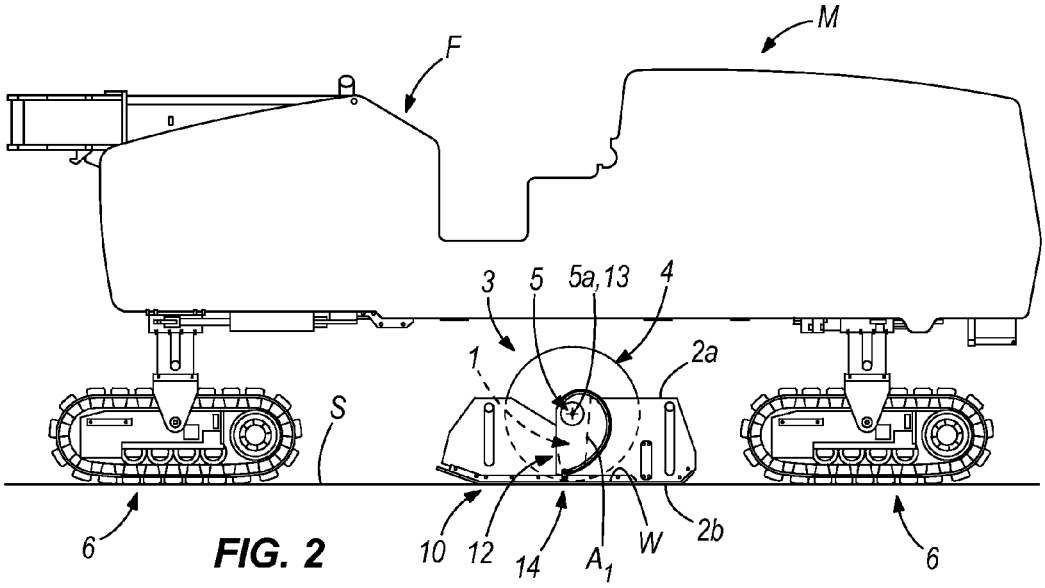
FIG. 2 is another, reduced side elevational view of a the closure device of FIG. 1, shown without certain components of the milling machine for clarity of illustration of the present invention.
Figure 3:
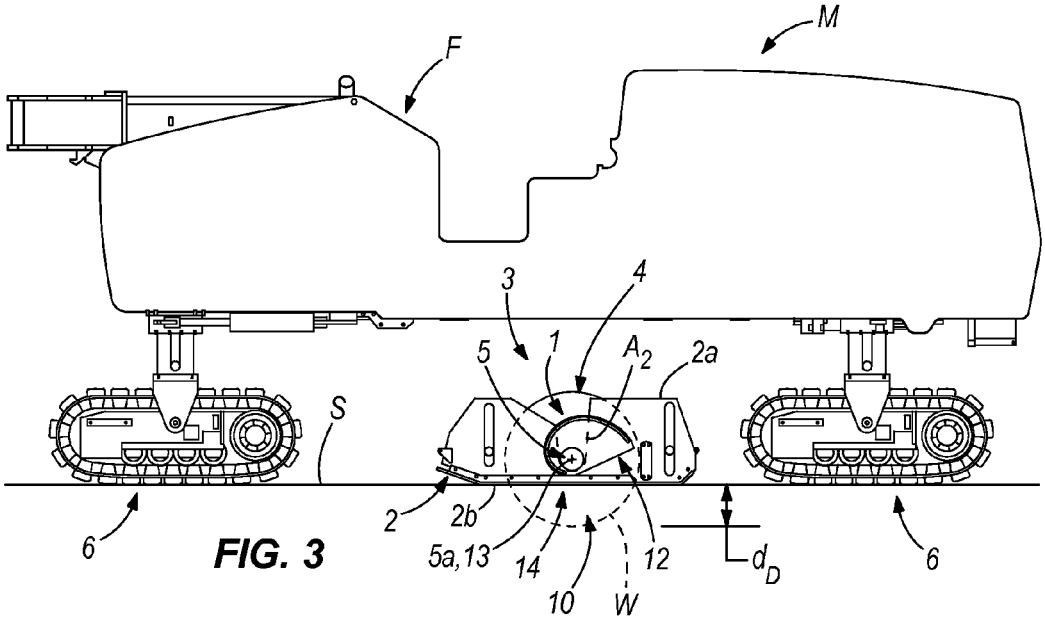
FIG. 3 is another view of FIG. 2, shown with the closure device in a second limit position and with the mainframe and cutting drum in lower positions.

Referring particularly to FIGS. 1 and 2, the milling machine M includes at least one and preferably four propulsion assemblies 6 (e.g., crawlers) disposed on a base surface S. The mainframe F is vertically displaceable with respect to the propulsion assemblies 6 to vertically displace the drum assembly 3, while the containment wall 2 remains generally disposed against the base surface S during movement of the mainframe F, as discussed in further detail below. Such movement of the mainframe F with respect to the base surface S increases (or alternatively decreases) the depth of engagement of the drum 4 with a working surface section W, and thus moves the drum shaft 5 between a first, upper position su (FIGS. 1, 2, 4, 8A and 9) and a second, lower position $s_L$ with respect to the containment wall 2 (FIGS. 2, 3, 5, 8E and 10).

Thus, such machine frame movement causes the containment wall 2 to be relatively displaced (i.e., relative to the drum 4, shaft 5, and barrier member 12) between lower and upper positions $w_L$, $w_U$, respectively. Specifically, at the wall lower position $w_L$ (e.g., FIG. 1), the drum shaft 5 is disposed at the upper position $s_1$ within the wall opening 1 and at the wall upper position $w_U$ (e.g., FIG. 2), the drum shaft 5 is located at the lower position $s_2$ within the wall opening 1. Further, at the drum shaft upper position $s_U$ and the wall lower position $w_L$, a greater portion of the wall opening 1 is disposed beneath the shaft 5 and alternatively, a greater portion of the opening 1 is disposed above the shaft 5 at the shaft lower position $s_L$/wall upper position $w_U$.

Therefore, displacement of the mainframe F moves the barrier member 12 with respect to the containment wall 2 and pivots the barrier member 12 about the axis 13. It is presently preferred to move the entire mainframe F to adjust the engagement depth of the drum 4 so as to avoid the necessity of displacing drive components 7 (FIG. 1) of the drum assembly 3 (e.g., drive belts, etc.) with respect to the mainframe F as would be otherwise be required. However, the milling machine M may alternatively be constructed such that the drum 4, the shaft 5 and at least a portion of the drive components 7 are moveable with respect to the mainframe F to adjust the drum depth $d_D$.

Figure 4:
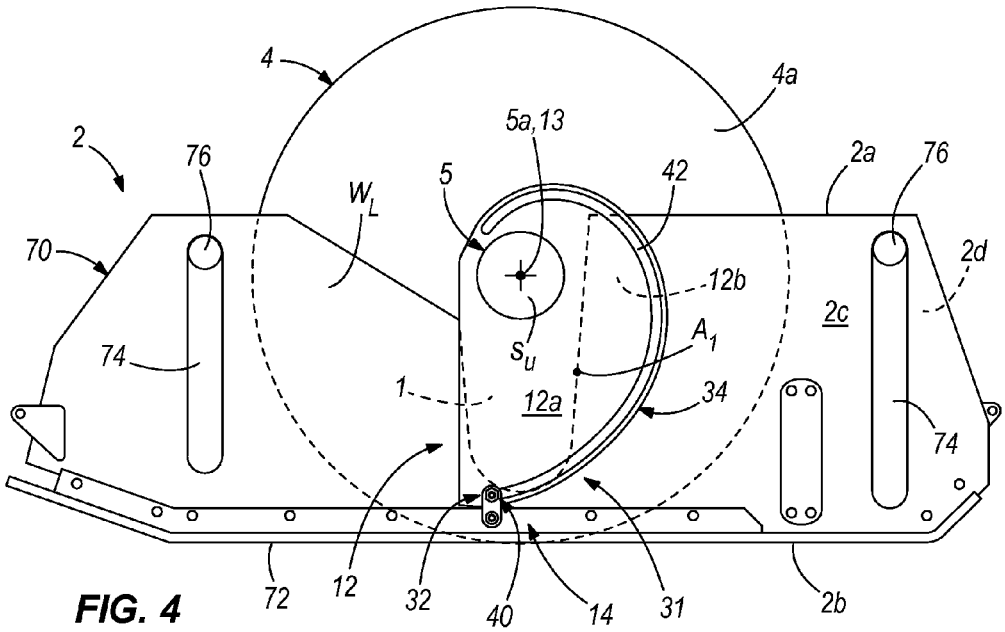
FIG. 4 is an enlarged elevational view of the closure device depicted in FIG. 2, shown without the milling machine mainframe and propulsion assemblies.
Figure 5:
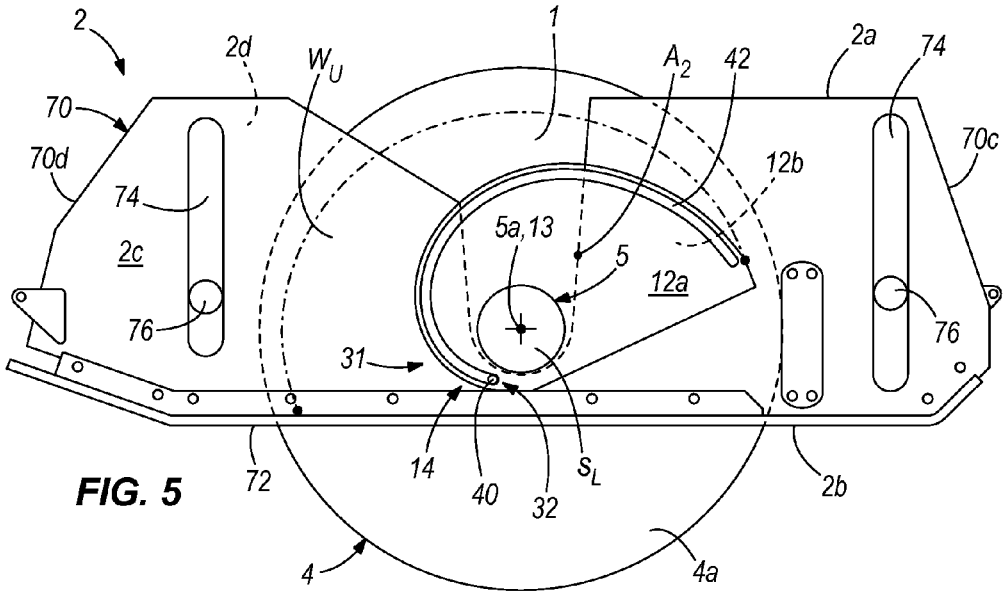
FIG. 5 is an enlarged elevational view of the closure device depicted in FIG. 3, shown without the milling machine mainframe and propulsion assemblies.
Figure 6:
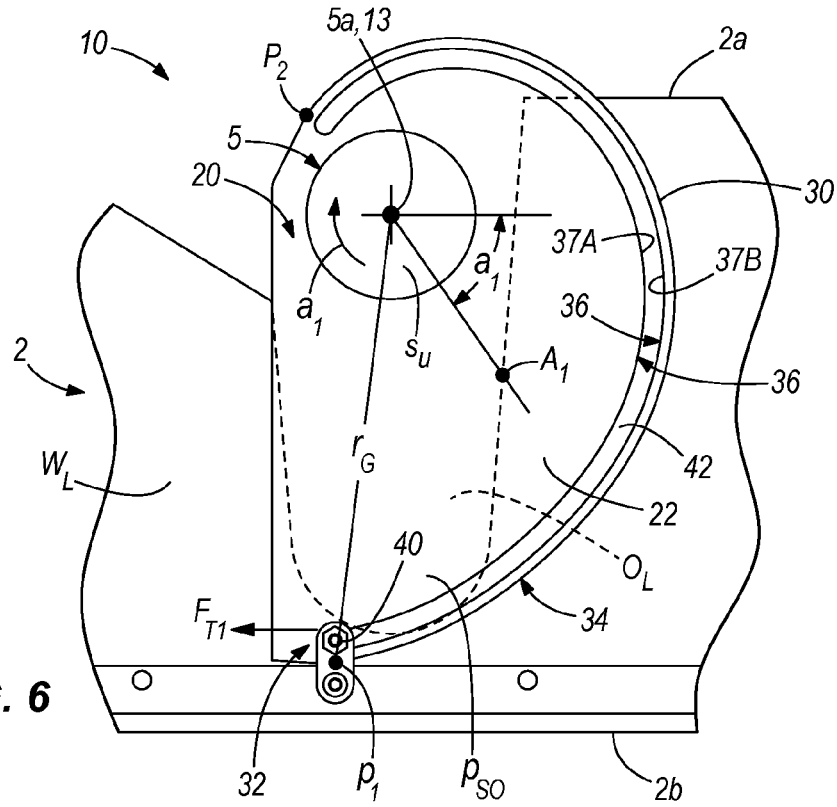
FIG. 6 is a more enlarged, broken away view of the closure device as depicted in FIG. 4.
Figure 7:
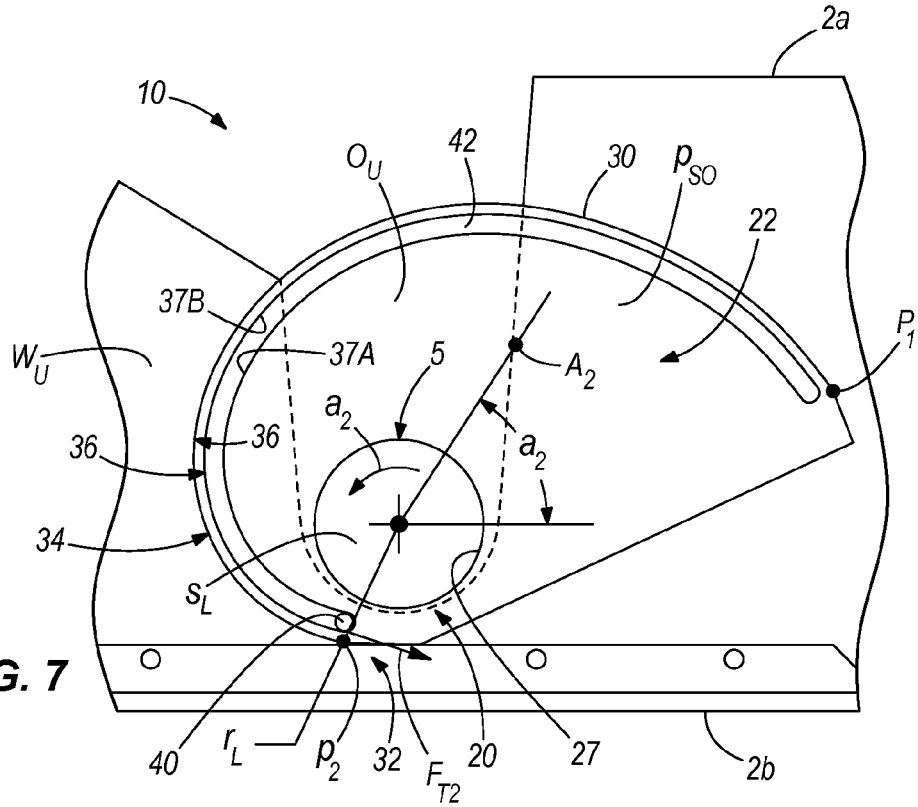
FIG. 7 is a more enlarged, broken away view of the closure device as depicted in FIG. 5.
Figure 8A:
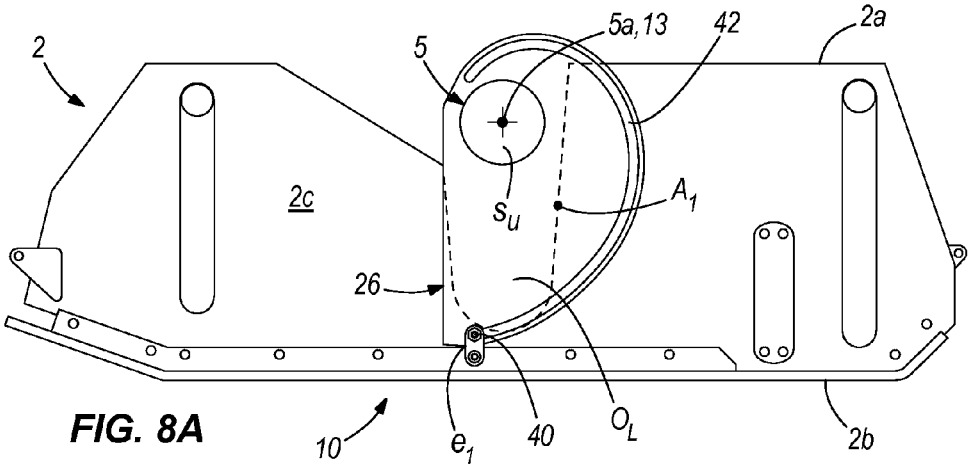
FIGS. 8A-8F, collectively
Figure 8B:
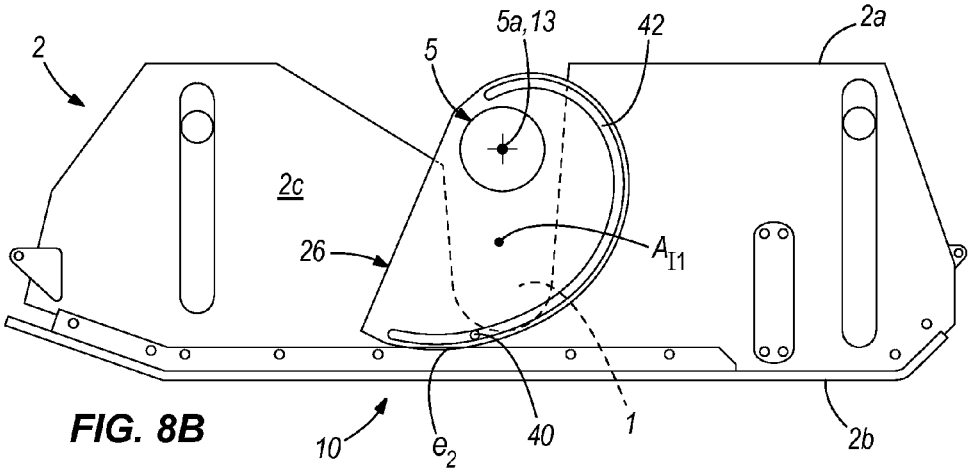
Figure 8C:
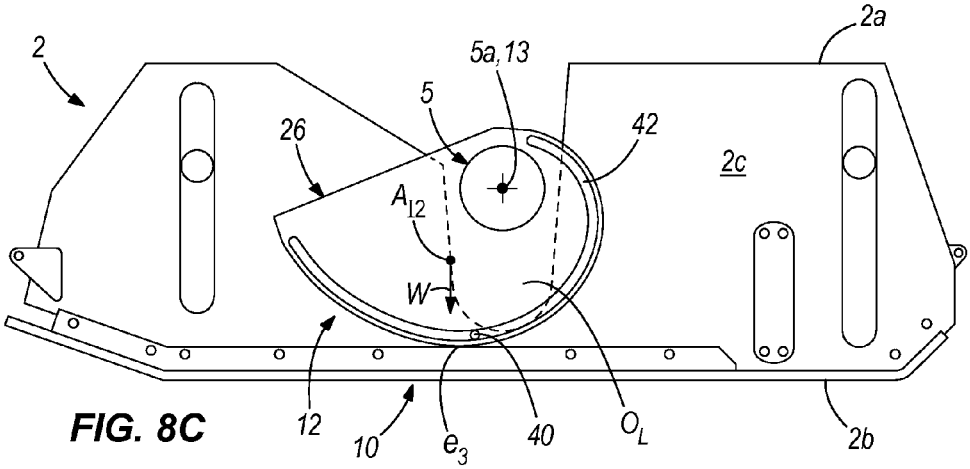
Figure 8D:
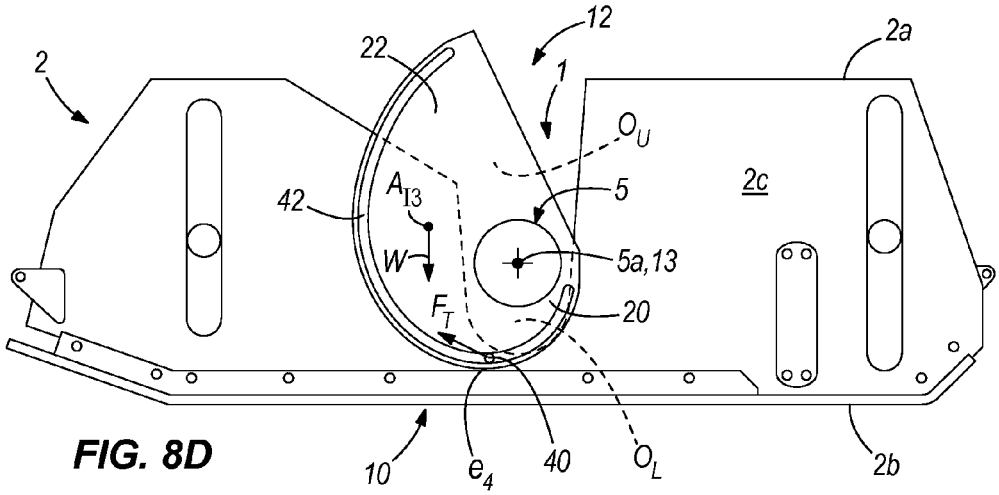
Figure 8E:
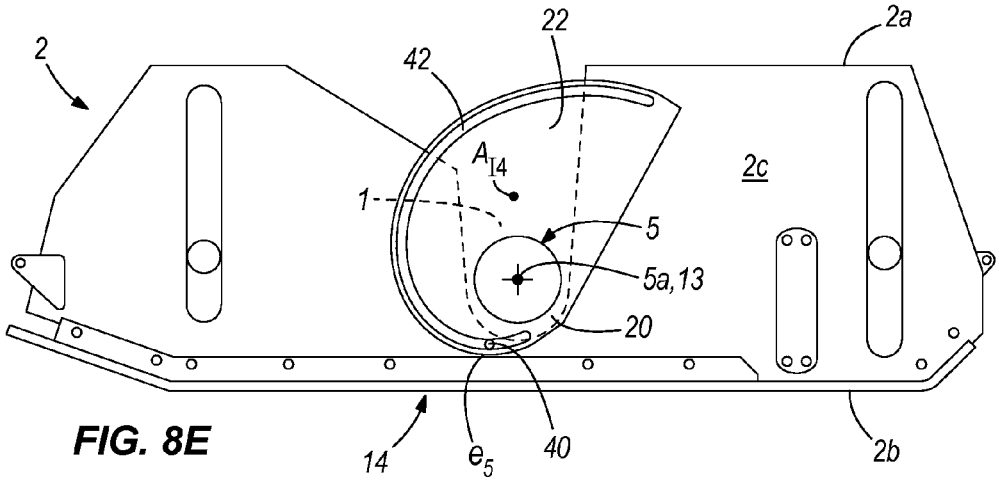
Figure 8F:
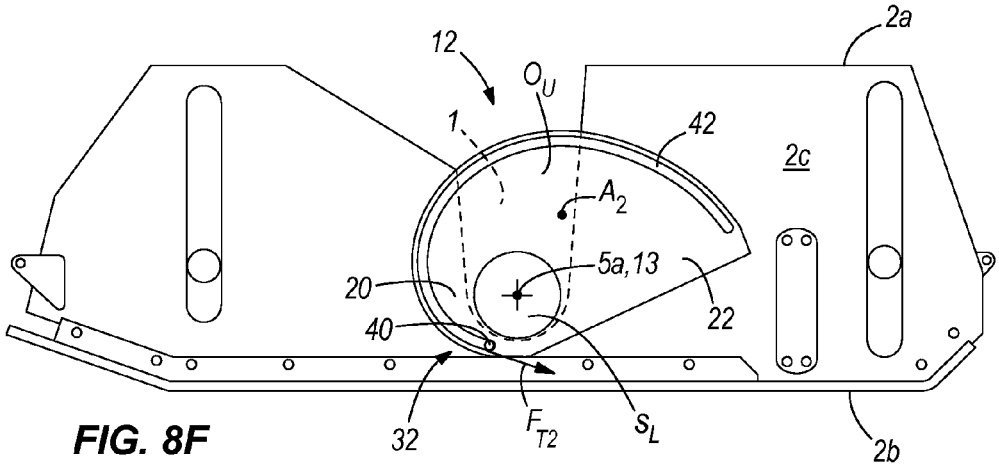

Referring now to FIGS. 2-8, in order to substantially cover the wall opening 1 regardless of the position of the drum shaft 5 within the opening 1, the barrier member 12 is pivotable about the barrier axis 13 between a first angular position Al (FIGS. 1, 2, 4, 6, 8A and 9) and a second angular position $A_2$ (FIGS. 3, 5, 7, 8E and 10). At the first angular position $A_1$, the barrier member 12 extends across lower sections $O_L$ of the wall opening 1 located generally below the drum shaft 2, as indicated in FIG. 6. Alternatively, at the second angular position $A_2$, the barrier member 12 extends across upper sections $O_U$ of the wall opening 1 located generally above the drum shaft 2, as best shown in FIG. 7. Preferably, the barrier member 12 pivots or angularly displaces through a total angular displacement $D_A$ of about one hundred thirty-five degrees when moving between the first and second angular or "limit" positions $A_1$, $A_2$. Further, the barrier member 12 displaces between the first and second limit positions $A_1$, $A_2$ when the drum shaft 5 moves between the upper and lower positions $s_U$, $s_L$, or alternatively the containment wall 2 moves between the lower and upper positions $w_L$, $w_U$. That is, as the mainframe F and drum shaft 5 move vertically to adjust the depth of the drum 4, or the wall 2 is moved vertically, the barrier member 12 both vertically displaces relative to the wall 2 (even with a stationary shaft 5 and displacing wall 2) and simultaneously pivots upon the shaft 5 and about axis 13 between the two angular positions $A_1$, $A_2$, as generally described above. It must be noted that, with the descriptions herein of the various component positions, the wall 2 is located at the lower position $w_L$ whenever the drum shaft 5 is located at the shaft upper position $s_U$, and vice versa, regardless of which component 2 or 5 has actually moved. The important consideration for understanding the structure and operation of the closure device 10 is that the barrier member 12 is moved to the particular angular position $A_N$ that provides coverage of at least a major portion of the wall opening 1 at every/any position of the shaft 5 within the opening 1.

It must be further noted that, in general, the barrier member 12 is typically incrementally or gradually displaced between the first and second positions $A_1$, $A_2$, as opposed to being substantially immediately displaced therebetween. Such gradual/incremental angular displacement typically occurs when the drum 4 and drum shaft 5 are moved vertically in a normal road milling operation, during which the depth $d_D$ (see FIG. 3) of the cutting drum 4 is gradually increased. As such, the barrier member 12 is disposeable at any one of a plurality of different, intermediate angular positions $A_{In}$ located between the two end or "limit" angular positions $A_1$, $A_2$, four such intermediate positions $A_{11}$, $A_{12}$, $A_{13}$, $A_{14}$ being depicted in FIGS. 8B-8E. Further, at each intermediate position $A_{IN}$, the barrier member 12 is oriented so as to cover both upper and lower sections $O_U$, $O_L$ of the wall opening 1 on either vertical side of the drum shaft 5 (see, e.g., FIG. 6D), as compared with the two limit positions $A_1$, $A_2$, at which the member 12 primarily covers only lower or upper opening sections $O_L$, $O_U$, respectively, as described above. That is, when the barrier member 12 moves, for example, from the first limit position $A_1$ toward the second limit position $A_2$, the barrier 12 substantially covers sections of the opening below the shaft 5, then increasingly begins to cover a greater portion of opening sections $O_U$ above the shaft 5, and lesser sections $O_L$ below the shaft 5, until the barrier 12 primarily obstructs the opening upper section(s) $O_U$ when the member 12 reaches the second limit position $A_2$ as the drum shaft 5 reaches the lower shaft position $s_L$. Alternatively, when the drum shaft 5 moves from the shaft lower position $s_L$ toward the upper position $s_U$, the barrier member 12 initially covers the opening upper section(s) $O_U$ (see FIG. 7), increasingly covers a greater portion of the opening 1 beneath the shaft 5, until primarily covering the opening lower section(s) $O_L$ (see FIG. 6).

Figure 9:
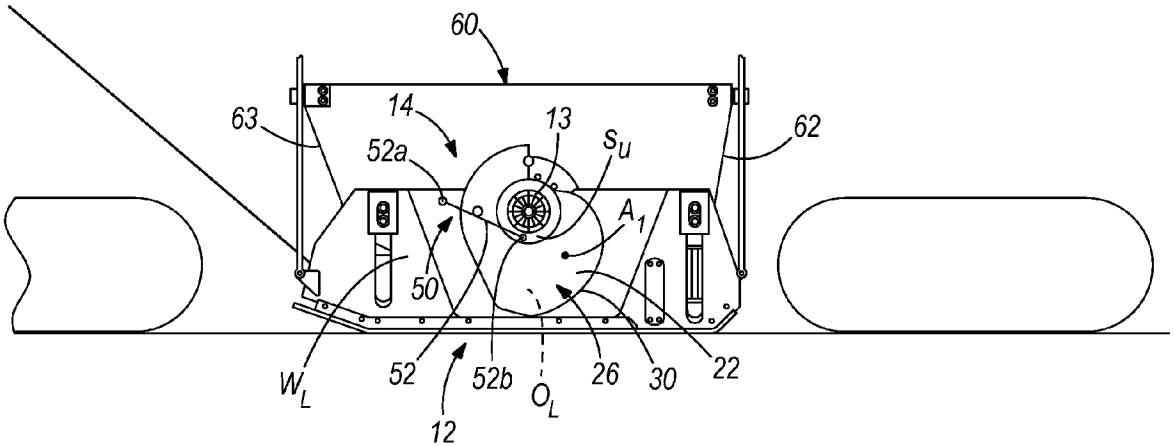
FIG. 9 is a side elevational view of a second construction closure device, shown in the first limit position.
Figure 10:
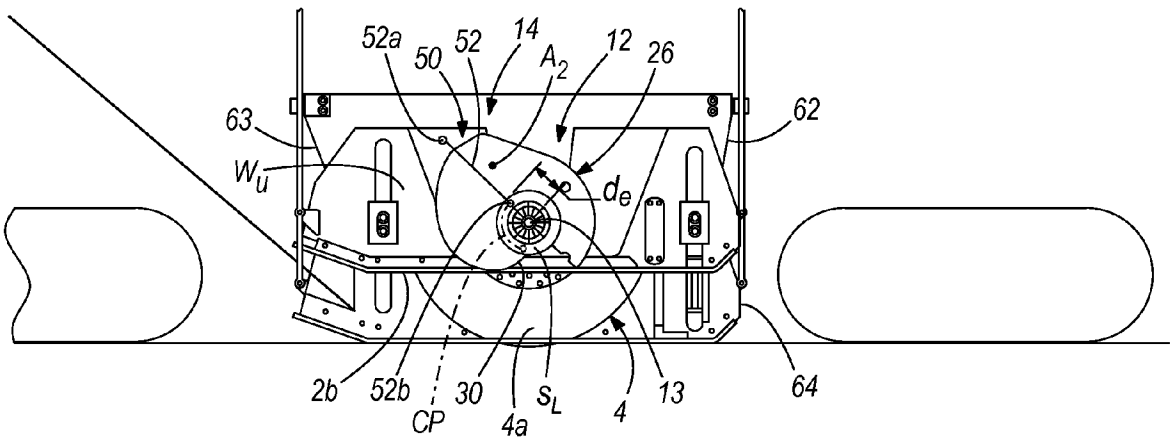
FIG. 10 is another view of the closure device of FIG. 9, shown in the second limit position.

Preferably, the barrier member 12 includes a base portion or hub 20 and a main, eccentric portion 22. The hub 20 is coupled with, and preferably mounted upon, the drum drive shaft 5, the barrier axis 13 extending centrally through the hub 20. The main, eccentric portion 22 extends generally radially from the hub/base portion 20, such that the barrier member 12 is generally ovular or egg-shaped (FIGS. 1-8 and 11) or has such an egg-shaped/ovular section (FIGS. 9, 10 and 12). Further, the barrier member 12 is configured (i.e., shaped, oriented, etc.) such that rotation of the hub/base portion 20 about the barrier axis 13 moves the barrier member 12 between the first and second angular, limit positions $A_1$, $A_2$. At the first limit position $A_1$, the eccentric portion 22 extends generally vertically downwardly from the base portion 20 to cover the opening lower section(s) $O_L$, and at the second angular position $A_2$, the eccentric portion 22 extends generally vertically upwardly from the base portion 20 to cover the opening upper section(s) $O_U$, as generally described above Referring to FIGS. 11 and 12, the barrier member 12 preferably includes a generally ovular, generally egg-shaped, or generally elliptical plate 26 having a shaft mounting opening 17 spaced from the center of mass CG of the plate 26, the barrier axis 13 extending centrally through the opening 17. The shaft opening 17 is configured to receive a portion of the drum shaft 5 so as to mount the plate 26 thereto, and thus the member base portion/hub 20 as described above is provided by sections of the plate 26 about the opening 17. With this structure, the plate 26 pivots eccentrically about the axis 13 and the plate 26 has a radially outermost section $P_{SO}$ that provides the barrier member main eccentric portion 22. As discussed above, the plate 26 is configured such that varying sections of the plate 26 extend across the containment wall opening 1 as the drum shaft 5 is displaced vertically. Specifically, the barrier member 12 is configured such that the plate outermost section $P_{SO}$ extends across the wall opening lower sections $O_L$ when the drum shaft 5 is at upper position su and/or the wall 2 is at the wall lower position $W_L$, and alternatively, the outermost section $P_{SO}$ extends across the opening upper sections $O_L$ when the shaft 5 is at lower position $s_L$ and/or the wall 2 at the upper position $w_U$.

Referring now to FIGS. 6, 7, 8, 11 and 12, the plate 26 is preferably constructed such that the plate outermost section $P_{SO}$ is formed as a generally spiral shaped section with a spiral outer edge 30 extending partially about the barrier axis 13. With such a plate structure, the barrier 12 is configured or arranged so that as the plate 26 moves between the first and second angular limit positions $A_1$, $A_2$, different sections en (e.g., sections $e_1$-$e_6$ in FIGS. 8A-8F) of the spiral edge 30 move generally along and remain proximal to (and preferably spaced above) the wall lower end 2*b*, while other edge sections (not indicated) move across the wall opening 1, as the plate 26 pivots about the barrier axis 13. That is, the plate 26 is specifically shaped and oriented such that the radially larger sections of the plate 26 are disposed proximal to the wall lower end 2*b* when the drum shaft 5 is located at the upper position su (or/and the wall 2 at the lower position $w_L$) (see, e.g., FIG. 6) and conversely, radially smaller sections of the plate 26 are disposed proximal to the wall lower end 2*b* when the drum shaft 5 is located at the lower position $s_L$ (or/and the wall 2 at the upper position $w_U$) (see, e.g., FIG. 7).

Figure 11:
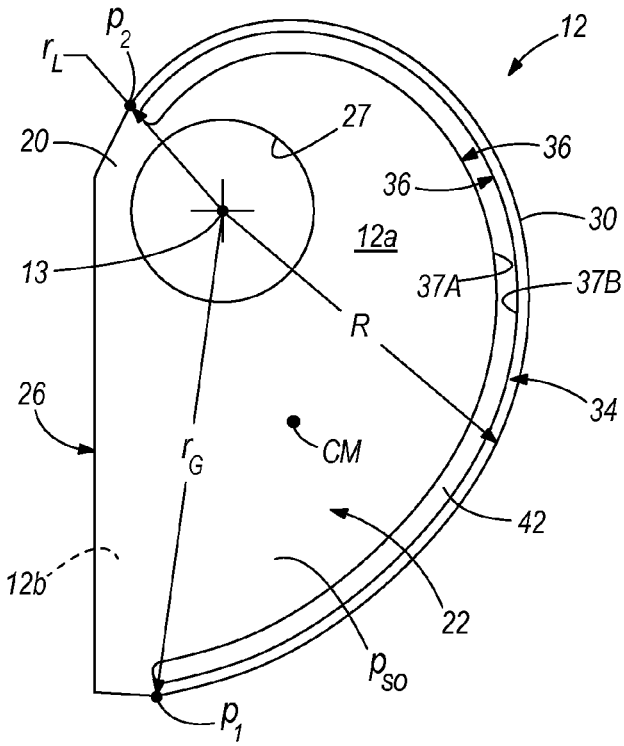
FIG. 11 is a front plan view of a first construction barrier plate.
Figure 12:
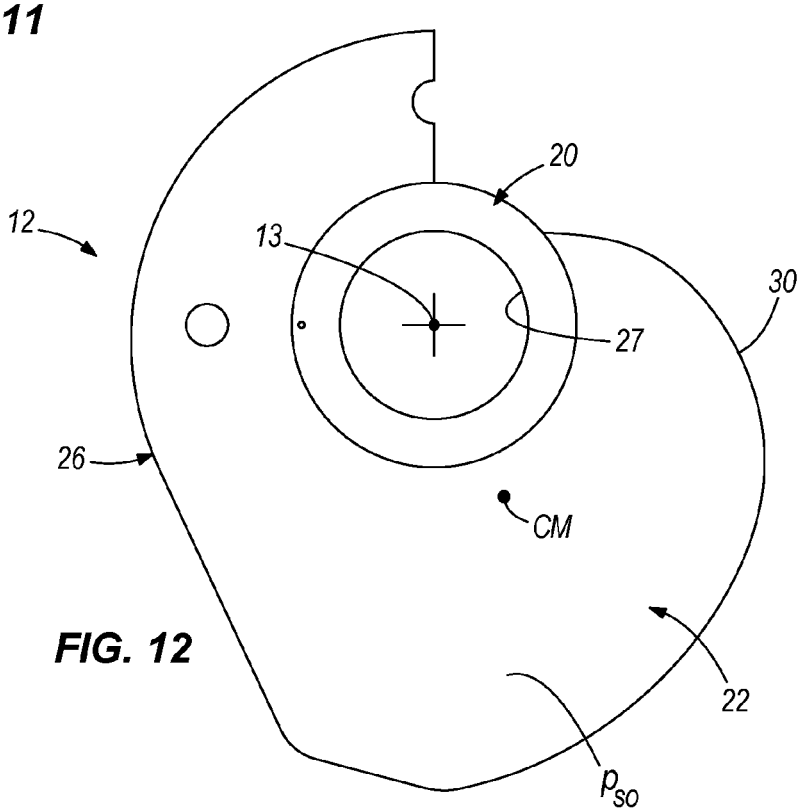
FIG. 12 is a front plan view of a second construction barrier plate.

More specifically, the spiral edge 30 has a radius R with respect to the barrier axis 13 that varies between a greatest value $r_G$ at a first edge point $p_1$ and a least value $r_L$ at a second edge point $p_2$, preferably in the manner of an involute curve, such that the first point $p_1$ is located more distally from the axis 13 than the second point $p_2$, as indicated in FIGS. 6, 7 and 11. Further, the barrier plate 26 is arranged about the axis 13 and with respect to the containment wall 2 such that in the barrier member first angular position $A_1$, the plate first edge point $p_1$ is located generally proximal to the containment wall lower end 2*b* and the plate greatest value radius $r_G$ extends generally vertically downwardly from the barrier axis 13, as shown in FIG. 6. Alternatively, when the barrier member 12 is at the second angular position $A_2$, the plate second edge point $p_2$ is located generally proximal to the wall lower end 2*b*, such that the plate edge least value radius $r_L$ extends generally vertically downwardly from the barrier axis 13, as indicated in FIG. 7.

Referring to FIGS. 4-7 and 11, the coupler 14 is preferably constructed as a linkage 31 that includes a follower 32 connected with either the containment wall 2 or the barrier member 12 and a camming member 34 coupled with the other one of the barrier member 12 and the containment wall 2. It is presently preferred to connect the follower 32 with the containment wall 2 and the camming member 34 with the barrier member 12, although it is within the scope of the present invention to "reverse" the mounting of the two components 32, 34 as described. In either case, the camming member 34 has at least one and preferably two camming surfaces 36 and the follower 32 is disposeable generally against the one or more camming surfaces 36. Further, the camming surface 36 is configured to direct movement of the follower 32 as the containment wall 2 moves with respect to the drum shaft 5 such that the barrier member 12 is pivoted about the barrier axis 13, as described above. Preferably, the camming surface (s) 36 each include at least a generally spiral-shaped surface section, and is/are preferably entirely spiral shaped, that extends circumferentially at least partially about the barrier axis 13, such that movement of the follower 32 along the spiral surface(s) 36 pivotally displaces the barrier member 12 about the barrier axis 13. In other words, the displacement of the follower 32, which is preferably constrained to linearly displace vertically with the containment wall 2 or is held generally stationary, or relative displacement of the barrier member 12, pushes the follower 32 against the spiral shaped surface 36 or vice-versa, causing the camming surface 36 to slide against the follower 32, which pivots the barrier member plate 26 about the axis 13, as discussed in greater detail below.

Most preferably, the follower 32 includes a roller 40 rotatably connected with the containment wall 2 such that vertical displacement of the wall 2 pushes the roller 40 against the camming surface 36 to pivot the barrier member 12 as described above, as the roller 40 displaces along the surface 36. The camming member 34 is preferably integrally formed with the barrier member 12, and is most preferably provided by a generally spiral shaped slot 42 formed in the plate 26 so as to extend generally along and parallel to the spiral shaped plate edge 30. As such, the preferred camming member 34 includes two spaced-apart, facing, inner and outer camming surfaces 37A, 37B. With two, inner and outer camming surfaces 37A, 37B, the roller 40 tends to push primarily against the inner surface 37A when the barrier member 12 is pivoted in a first direction $a_1$ (FIG. 6) from the first angular position $A_1$ toward the second angular position $A_2$; in other words, when the mainframe F, the drum 4 and shaft 5 are moved downwardly (or the wall 2 moved upwardly). Alternatively, the roller 40 tends to push primarily against the outer surface 37A when the barrier member 12 is pivoted in a second direction $a_2$ (FIG. 7) from the second angular position $A_2$ toward the first angular position $A_1$ as the drum 4 and frame F move upwardly (or the wall 2 moved downwardly). Although a spiral shaped slot 42 is presently preferred, the camming surface(s) 36 may alternatively be provided by a separate spiral shaped rail mounted to the plate 26 or by any other appropriate component or device, or may even be provided by the plate outer edge 30 used with an appropriately constructed follower (none shown).

Referring to FIGS. 6-8, with the preferred structure, the barrier plate 26 is driven to pivot about the barrier axis 13 by the interaction of the roller 40 and cam slot 42 in the following manner. Specifically, when the drum shaft 5 is located at the upper position su and moves downwardly (or the wall 2 moves upwardly), the inner camming surface 37A is pushed downwardly against the roller 40, or vice versa. Due to the geometry of the curved slot 42 and the constraint of the roller 40 being held stationary or to vertical linear displacement, the downward movement of the barrier member 12 causes the inner camming surface 37A to slide against the roller 40, such that the barrier member 12 is forced to pivot about the axis 13. The maximum angular displacement of the barrier plate 26 for a given vertical linear displacement of the shaft 5 (or wall 2), and thus also the angular velocity of pivotal movement, occurs at initial movement from the shaft upper position $s_U$ (or wall lower position $w_L$), at which the plate 26 moves from the first limit position $A_1$, due to the greater magnitude $r_1$ of the radius R at and near the camming surface first point $p_1$. As the plate 26 is pivoted, the weight W (see, e.g., FIG. 8D) of the plate 26 acts against the force $F_{T1}$ (see FIG. 8) exerted by the roller 40 that pivots the plate 26, until the plate 26 reaches about the angular position $A_{I4}$ indicated at FIG. 6E, at which the plate center of mass is above the axis 13. After such plate "balance" position, the plate weight W acts to pivot the plate 26 toward the second limit position $A_2$, so that the roller 40 functions to control the assent of the plate 26 toward the second limit position $A_2$.

Alternatively, when the drum shaft 5 is located at the lower position $s_U$ and moves upwardly (or the wall 2 moves downwardly), the outer camming surface 37B is pushed upwardly against the roller 40, or vice versa. As such, the outer camming surface 37B slides against the roller 40, causing the barrier member 12 to pivot in the second direction $a_2$ about the axis 13. The initial angular displacement/angular acceleration of the plate 26 for a given vertical linear displacement of the shaft 5 (or wall 2) is lesser when the plate 26 moves from the second limit position $A_2$, as compared with movement from the first limit position $A_1$, due to the close proximity of the roller 40 to the axis 13, i.e., the magnitude of $r_2$ at the camming surface second limit point $p_2$ is substantially lesser. As the plate 26 is pivoted, the weight W of the plate 26 acts against the force $F_{T2}$ exerted by the roller 40 until the plate 26 again reaches about the plate balance position $A_{I4}$, after which the weight W pivots the plate 26 toward the first limit position $A_2$ while roller 40 controls the plate assent thereto. Further, the angular displacement/velocity increases for a given drum shaft displacement (or wall displacement) due to the increasing magnitude of the camming surface radius R as the plate 26 approaches the first limit position $A_1$.

Referring to FIGS. 9, 10 and 12, the coupler 14 may alternatively be formed as a linkage 50 that includes at least one flexible connective element 52 extending between the containment wall 2 and the barrier member 12. Specifically, the connective element 52 has a first end 52*a* attached to the containment wall 2 and a second end 52*b* connected with the barrier member 12. The first end 52*a* is preferably spaced above the second end 52*a* and the second end 52*b* is spaced at a radial distance $d_R$ (FIG. 10) from the barrier axis 13. As such, downward vertical movement of the drum shaft 5 with respect to the containment wall 2 (or vice-versa) moves the connective element second end 52*b* along a circular path CP (FIG. 10) about the barrier axis 13, so as to thereby pivot the plate 26 about the axis 13. Specifically, the element first end 52*a* is retained at a fixed vertical position (i.e., on the stationary containment wall 2), such that displacement of the mainframe F and drum shaft 5 moves the barrier member 12 with respect to the containment wall 2, causing the connective element second end 52*b* to both displace vertically and move radially about the barrier axis 13 to thereby pivot the barrier plate 26. However, when the containment wall 2 displaces with respect to the drum shaft 5, the resulting linear displacement of the connective member first end 52*a* pulls the second member end 52*b* to move along the circular path CP about the barrier axis 13, while the barrier member axis 13 (and the shaft 5A) remains at a particular vertical position.

In either preceding case, when either the drum shaft 5 moves upwardly relative to the containment wall 2 or the wall 2 moves downwardly with respect to the shaft 5, the two connective member ends 52*a*, 52*b* generally move toward each other, such that the element becomes "slack". The barrier member 12 is arranged or oriented on the axis 13 so as to locate the plate center of mass CM such that the weight W of the barrier member 12 causes the plate 26 to pivot back to the first angular limit position Al. However, the linkage 50 may further include another or second connective element (not shown) arranged to positively displace the barrier member plate 26 back to the first angular position Al when the first connective member 52 becomes slack during movement of the shaft 5 to the upper position su or the wall 2 to the lower position $w_L$.

Referring to FIGS. 1, 9 and 10, the closure device 10 is preferably used with a milling machine M having a material containment housing 60 including the slotted containment wall 2, a pair of front and rear walls 62, 63, and a "solid" side wall 64 (see FIG. 10) laterally opposite the slotted containment wall 2. The drum 4 is generally enclosed within a containment space CS defined by the containment housing 60, such that material cuttings are generally retained therein until being transported therefrom by a conveyor 66. As the drum shaft 5 is preferably connected with only one lateral side 4*a* of the drum 4, the containment housing 60 only has one containment wall 2 with a vertical opening 1, and thus only a single closure device 10. However, as drum shaft 5 may extend completely through the drum 4, or the milling machine M may include two drum shafts 5 each connected to a separate lateral side of the drum 4, the milling machine M may alternatively include two slotted containment walls 2 and two closure devices 10.

Figure 13:
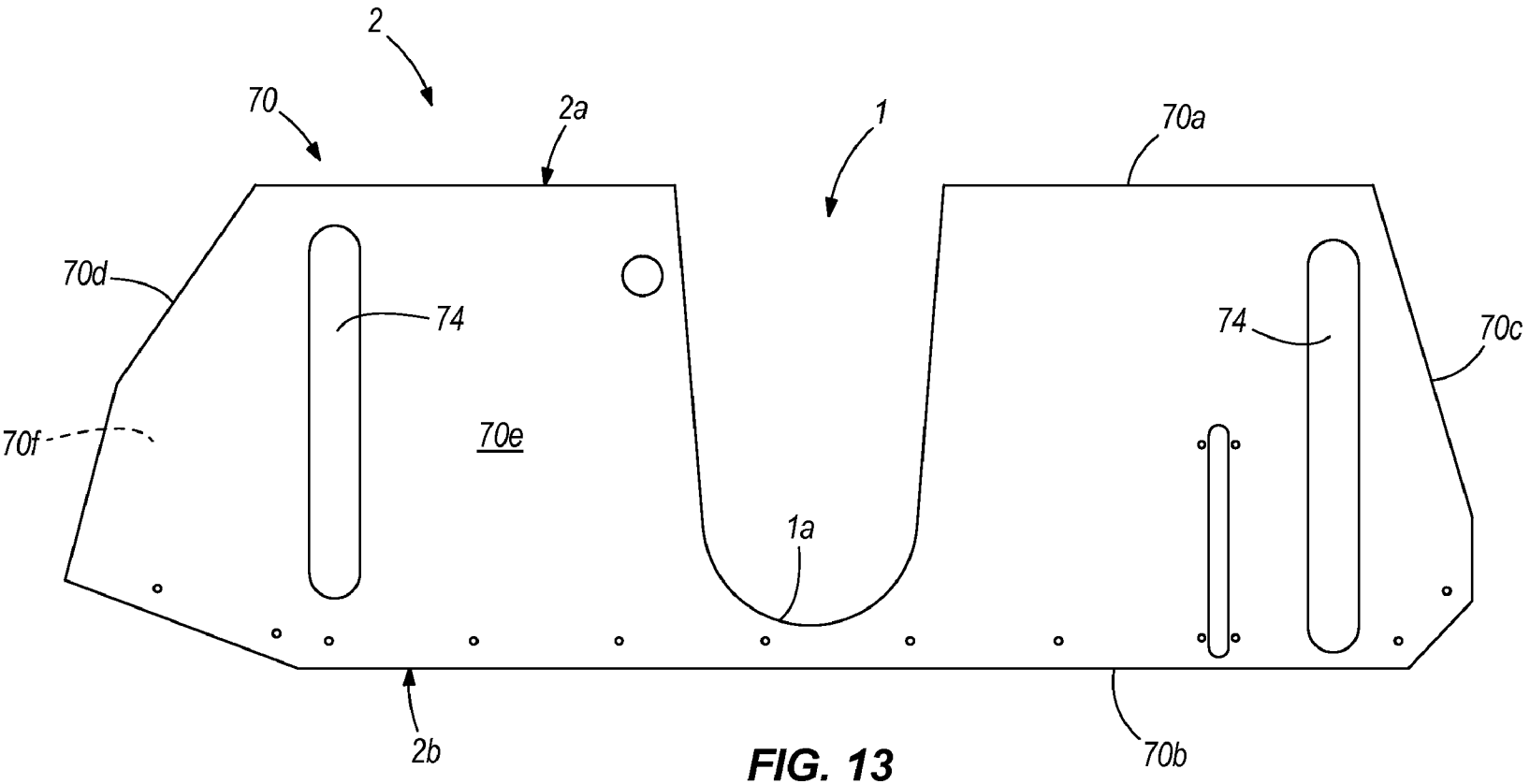
FIG. 13 is a front plan view of a containment wall plate.

Referring specifically to FIGS. 4, 5 and 13, the slotted containment wall 2 preferably includes a generally rectangular plate 70 and an elongated rail or skid 72. The containment plate 70 has upper end lower edges 70*a*, 70*b* providing the wall upper and lower ends 2*a*, 2*b*, front and rear edges 70*c*, 70*d*, and opposing inner and outer vertical surfaces 70*e*, 70*f*. The wall opening 1 extends downwardly from the plate upper edge 7*b* toward the lower edge 70*b*, and is substantially rectangular with a lower curved end 1*a* sized to fit generally closely about the shaft 5 when the shaft 5 is located at the lower position $s_L$. Further, the plate 70 preferably includes a pair of vertical guide slots 74 through each of which extends a pin or shaft 76 connected with the mainframe F so as to slidably couple the containment wall 2 with the mainframe F. Furthermore, the skid 72 is preferably connected with the lower edge 70*b* of the plate 70 so as to extend along at least a major portion thereof. The skid 70 is configured to slide generally upon the base surface S when the milling machine M travels thereupon.

Figure 15:
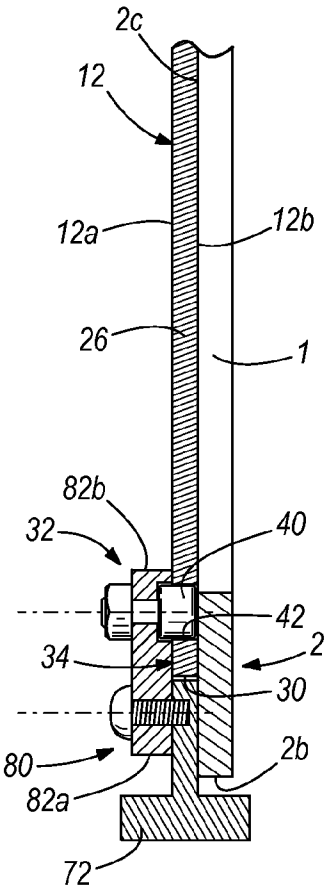
FIG. 15 is a cross-sectional view through line 15-15 of FIG. 14.
Figure 14:
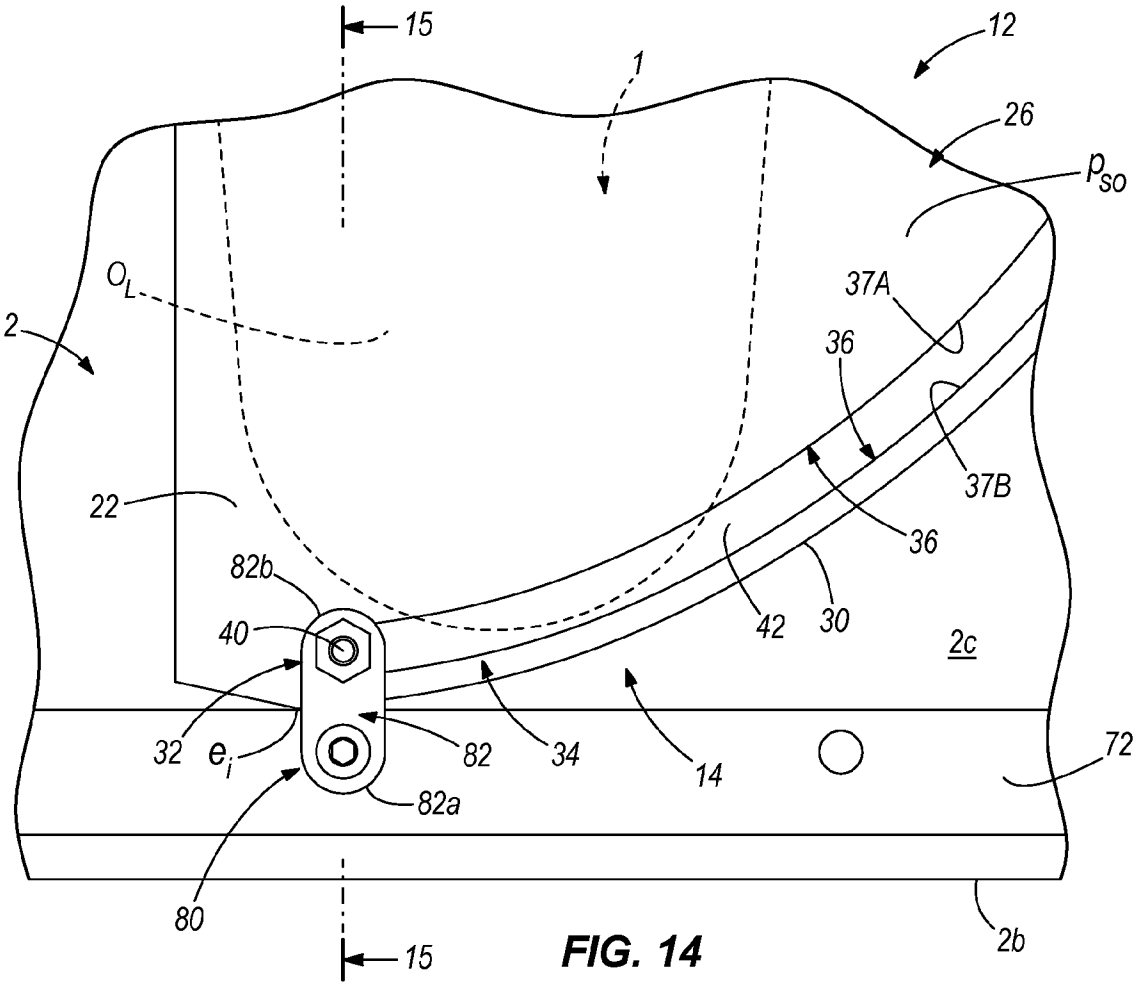
FIG. 14 is a greatly enlarged, broken away front plan view of a the closure device, showing a portion of a preferred coupler.

Referring now to FIGS. 14 and 15, the preferred coupler roller 40 is preferably mounted to the slotted containment wall 2 by means of a generally vertically extending bracket 80. The bracket 80 is preferably formed as a generally rectangular bar or plate 82 having a lower end 82 attached to the wall 2, most preferably to the skid 72, and an upper, free end 82*b* configured to rotatably support the roller 40. The roller 40 extends inwardly from the plate 82 and into the slotted camming opening 42 of the preferred barrier plate 26.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined generally herein and/or in the appended claims.

We claim:

1. A device for closing a shaft opening in a containment wall of a milling machine cutter drum assembly, the drum assembly including a rotatable drum and a drive shaft for rotating the drum about a shaft axis, the shaft extending through the shaft opening in the containment wall so as to connect the drum with a mainframe of the milling machine, at least one of the drive shaft and the containment wall being vertically movable and the shaft opening extending generally vertically in the containment wall, the closure device comprising:

a barrier member movably couplable with the mainframe so as to be pivotable about a barrier axis, the barrier axis being generally fixed with respect to the drive shaft such that the barrier member is linearly displaceable with respect to the containment wall, the barrier member being disposeable generally against the containment wall so as to extend at least partially across the shaft opening to generally prevent material flow through the shaft opening; and a coupler configured to movably couple the barrier member with the containment wall such that vertical linear displacement of one of the drive shaft with respect to the containment wall and the containment wall with respect to the drive shaft angularly displaces the barrier member about the barrier axis as the vertical position of the drive shaft within the shaft opening is varied so that at least a portion of the barrier member extends across and generally obstructs the shaft opening.

2. The closure device as recited in claim 1 wherein:

the milling machine includes at least one propulsion assembly disposed on a base surface, the mainframe is vertically displaceable with respect to the propulsion assembly to vertically displace the drum assembly, and the containment wall remains generally disposed against the base surface during movement of the mainframe; and displacement of the mainframe moves the barrier member with respect to the containment wall and pivots the barrier member about the barrier axis.

3. The closure device as recited in claim 1 wherein the barrier member axis is at least generally collinear with the shaft axis.

4. The closure device as recited in claim 3 wherein the barrier member is pivotally couplable with the drive shaft.

5. The closure device as recited in claim 1 wherein:

the containment wall has upper and lower ends, the shaft opening extends generally between the ends of the containment wall, and the containment wall is relatively displaceable between a lower position, at which the drive shaft is disposed at a first, upper position within the shaft opening, and an upper position, at which the drive shaft is located at a second, lower position within the shaft opening; and the barrier member is pivotable about the barrier axis between a first angular position, at which the barrier member extends across sections of the shaft opening located generally below the drive shaft, and a second angular position at which the barrier member extends across sections of the shaft opening located generally above the drive shaft, the barrier member displacing between the first angular position and the second angular position when the containment wall moves between the upper position and the lower position.

6. The closure device as recited in claim 5 wherein the barrier member includes a base portion couplable with the drive shaft, the barrier axis extending centrally through the base portion, and a main, eccentric portion extending generally radially from the base portion, the barrier member being configured such that rotation of the base portion about the barrier axis moves the barrier member between the first angular position, at which the eccentric portion extends generally vertically downwardly from the base portion, and the second angular position, at which the eccentric portion extends generally vertically upwardly from the base portion.

7. The closure device as recited in claim 6 wherein the barrier member pivots through a total angular displacement of about one hundred thirty-five degrees when moving between the first angular position and the second angular position.

8. The closure device as recited in claim 6 wherein the barrier member includes a plate having a generally spiral shaped section with an outer edge extending partially about the barrier axis, the outer edge having a radius with respect to the barrier axis that varies between a greatest value and a least value, the barrier plate being arranged with respect to the containment wall such that the outer edge having the greatest value radius extends generally vertically downwardly from the barrier axis in the first angular position and the outer edge having the least value radius extends generally vertically downwardly from the barrier axis in the second angular position.

9. The closure device as recited in claim 8 wherein the plate includes a generally spiral shaped rail extending generally along the outer edge and the coupler includes a roller rotatably connectable with the containment wall and disposed generally against the rail such that vertical movement of the containment wall with respect the plate pushes the roller against the rail so that the plate is pivoted about the barrier axis as the roller displaces along the rail.

10. The closure device as recited in claim 1 wherein the barrier member includes a plate, the barrier axis being spaced from a geometric center of the plate such that the plate pivots eccentrically about the barrier axis and the plate has a radially outermost section, the barrier member being configured such that varying sections of the plate extend across the containment wall opening as the containment wall displaces vertically.

11. The closure device as recited in claim 10 wherein:

the containment wall is movable between a lower position and an upper position, a greater portion of the shaft opening being disposed beneath the drive shaft in a lower position of the containment wall and a greater portion of the shaft opening being disposed above the shaft in an upper position of the containment wall; and the barrier member is configured such that the outermost section of the plate extends across the shaft opening when the containment wall is located at the lower position.

12. The closure device as recited in claim 11 wherein;

the containment wall has a lower end disposeable against a base surface, the milling machine being generally disposed upon the base surface; and the barrier plate has an outer edge extending circumferentially about the barrier axis, the outer edge including a generally spiral shaped section having a first point and a second point each spaced radially from the barrier axis, the first point being located more distally from the barrier axis than the second point, the plate being positioned about the barrier axis such that the first point is located generally proximal to the lower end of the containment wall when the containment wall is in the lower position and the second point is located generally proximal to the lower end of the containment wall when the containment wall is in the upper position, the spiral edge section moving generally along to the lower end of the containment wall and the shaft opening as the plate pivots about the barrier axis.

13. The closure device as recited in claim 1 wherein:

the drive shaft is varyingly located within different sections of the shaft opening as the containment wall displaces vertically with respect to the mainframe such that varying remaining sections of the shaft opening are unobstructed by the shaft; and the coupler is configured to pivot the barrier member about the barrier axis such that at least a portion of the barrier member extends across and generally obstructs the remaining sections of the shaft opening.

14. The closure device as recited in claim 1 wherein the coupler includes:

a follower connectable with one of the barrier member and the containment wall; and a camming member connectable with the other of the barrier member and the containment wall and having a camming surface, the follower being disposeable against the camming surface, the camming surface being configured to direct movement of the follower as the containment wall moves with respect to the drive shaft such that the barrier member is pivoted about the barrier axis.

15. The closure device as recited in claim 14 wherein the camming surface includes a generally spiral-shaped surface section extending circumferentially at least partially about the barrier axis such that movement of the follower along the surface section pivotally displaces the barrier member about the barrier axis.

16. The closure device as recited in claim 14 wherein the follower includes a roller rotatably connectable with the containment wall such that vertical displacement of the containment wall pushes the roller against the camming surface so that the barrier member is pivoted about the barrier axis.

17. The closure device as recited in claim 14 wherein:

the follower includes a roller mountable to the one of the barrier member and the containment wall;

the camming member includes a generally spiral-shaped rail connectable with the other one of the barrier member and the containment wall and located such that the roller rolls along the rail as the containment wall moves with respect to the drive shaft.

18. The closure device as recited in claim 1 wherein the coupler includes a flexible connective element having a first end attachable to the containment wall and a second end connected with the barrier member, the first end being spaced generally above the second end and the second end being spaced at a distance from the barrier axis such that vertical movement of the containment wall with respect to the drive shaft moves about a circular path about the barrier axis so as to pivot the barrier member about the barrier axis.

19. The closure device as recited in claim 18 wherein:

the milling machine includes at least one propulsion assembly disposed on a base surface, the mainframe is vertically displaceable with respect to the propulsion assembly to vertically displace the drum assembly, and the containment wall remains generally disposed against the base surface during movement of the mainframe; and displacement of the mainframe moves the barrier member with respect to the containment wall such that the first end of the connective element displaces vertically so that second end of the connective element moves around the barrier axis to pivot barrier member.

20. The closure device as recited in claim 1 wherein the barrier member includes a generally ovular plate, the barrier member being configured such that the barrier axis is spaced from the plate center so that the plate pivots generally eccentrically about the barrier axis.

21. The closure device as recited in claim 20 wherein the plate has a center and a mounting hole spaced from the center, the mounting hole being configured to receive a portion of the drive shaft so as to mount the barrier member about the shaft axis.

22. The closure device as recited in claim 1 wherein:

the containment wall has an inner vertically extending surface and an opposing outer vertically extending surface, the shaft opening extending through the containment wall between the vertical extending surfaces, and a body of the drum is spaced horizontally from the wall inner surface; and the barrier member is disposed one of between the wall inner surface and the body of the drum and generally adjacent the outer vertically extending surface such that the containment wall is disposed generally between the barrier member and the body of the drum.

23. The closure device as recited in claim 1 wherein the barrier member has opposing generally vertically-extending surfaces, one of the opposing generally vertically-extending surfaces being disposed generally against the one of the inner vertically extending surface of the containment wall and the outer vertically extending surface of the containment wall such that the one of the opposing generally vertically-extending surfaces of the barrier member generally slidably pivots against the one of the inner vertically extending surface of the containment wall and the outer vertically extending surface of the containment wall.

24. A device for closing a shaft opening in a containment wall of a milling machine cutter drum assembly, the drum assembly including a drive shaft extending through the shaft opening in the containment wall so as to connect the drum assembly with a mainframe of the milling machine, the containment wall being vertically movable with respect to the drive shaft and the shaft opening extending vertically in the containment wall, the closure device comprising:

a barrier member movably connectable with the mainframe so as to be pivotable about barrier axis, the barrier axis being generally fixed such that the containment wall is linearly displaceable with respect to the barrier axis, the barrier member being disposeable generally against the containment wall so as to extend at least partially across the shaft opening to prevent material flow through the shaft opening; and a linkage configured to angularly displace the barrier member about the barrier axis when the containment wall displaces vertically with respect to the drive shaft such that at least a portion of the barrier member extends across and generally obstructs the shaft opening as the drive shaft displaces vertically within the shaft opening.

25. The closure device as recited in claim 24 wherein the linkage includes one of:

a follower connectable with one of the barrier member and the containment wall and a camming member connectable with the other of the barrier member and the containment wall and having a camming surface, the follower being disposeable against the camming surface, the camming surface being configured to direct movement of the follower as the containment wall moves with respect to the drive shaft such that the barrier member is pivoted about the barrier axis; and a flexible connective element having a first end attachable to the containment wall and a second end connected with the barrier member, the first end being spaced generally above the second end and the second end being spaced at a distance from the barrier axis such that vertical movement of the containment wall with respect to the drive shaft moves about a circular path about the barrier axis so as to pivot the barrier member about the barrier axis.

26. A milling machine cutter assembly, the machine including a mainframe, the cutter assembly comprising:

a cutter drum having lateral ends and being rotatable about a central axis;

a drive shaft connected with and configured to rotate the drum;

a containment wall configured to generally contain material along one lateral side of the drum and having a vertically extending drive opening, the drive shaft extending through the drive opening so as to be operable to connect the drum with the mainframe, the containment wall being vertically movable with respect to the drive shaft and the drive opening extending vertically in the containment wall;

a barrier plate movably connectable with the mainframe so as to be pivotable about barrier axis, the barrier axis being generally fixed such that the containment wall is linearly displaceable with respect to the barrier axis, the barrier plate being disposeable generally against the containment wall so as to extend at least partially across the drive opening to prevent material flow through the drive opening; and a coupler configured to movably couple the barrier member with the containment wall such that vertical linear displacement of the containment wall with respect to the drive shaft angularly displaces the barrier member about the barrier axis as a vertical position of the drive shaft within the drive opening is varied so that at least a portion of the barrier member extends across and generally obstructs the drive opening.

* * * * *

UNITED STATES PATENT AND TRADEMARK OFFICE

CERTIFICATE OF CORRECTION

PATENT NO. : 7,665,806 B2
APPLICATION NO. : 11/451786
DATED : February 23, 2010
INVENTOR(S) : Rotz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 711 days.

Signed and Sealed this

Seventh Day of December, 2010

David J. Kappos

David J. Kappos
*Director of the United States Patent and Trademark Office*